US005197631A

United States Patent [19]

Mishima

[11] Patent Number: 5,197,631

[45] Date of Patent: Mar. 30, 1993

[54] MECHANISM FOR AUTOMATICALLY PUSHING UP TISSUES

[76] Inventor: Eiichi Mishima, 1688-57 Yuge, Tatsuta-machi, Kumamoto-shi, Kumamoto, Japan, 860

[21] Appl. No.: 879,276

[22] Filed: May 7, 1992

[30] Foreign Application Priority Data

Dec. 6, 1991 [JP] Japan ..... 3-108939[U]

[51] Int. Cl.[5] ..... B65H 1/00

[52] U.S. Cl. ..... 221/52; 221/56; 221/58; 221/60; 221/279

[58] Field of Search ..... 221/52, 56, 58, 59, 221/60, 279

[56] References Cited

U.S. PATENT DOCUMENTS 2,634,855 4/1953 Mandel ..... 221/59

3,942,682 3/1976 McKay ..... 221/58

*Primary Examiner*—David H. Bollinger

*Attorney, Agent, or Firm*—Cushman, Darby & Cushman

[57] ABSTRACT

A mechanism for automatically pushing up tissues which includes a box and a pusher. The box stores the tissues in layers and has a top wall with an opening formed therein for picking up tissues therethrough. The pusher is disposed under the tissues in the box for pushing up tissues. The pusher includes a flat base, main leg, subleg and a force member. The tissues are placed in layers on the flat base. The main leg has an upper end fixed to a lower face of the base so that the main leg may be freely folded relative to the base. The subleg is connected to the main leg and has a first end contacting the lower face of the base. The first end of the subleg is displaced from the fixed upper end of the main leg for supporting the base in a substantially horizontal state. The force member is attached to the main leg and subleg for forcing the main leg and subleg to push up the base.

9 Claims, 9 Drawing Sheets

MECHANISM FOR AUTOMATICALLY PUSHING UP TISSUES

BACKGROUND OF THE INVENTION

1. Field of the Invention

This invention relates to a mechanism for automatically pushing up tissues stored in layers in a box.

2. Description of the Prior Art

Tissues are now widely used in homes and offices for wiping up cosmetics, oils, etc., and for other purposes. The tissues are usually made of chemical pulp mixed with polyamid-polyamine-epichlorohydrin-based wet strengthening resin to improve tear resistance, softness, fuzz suppression, and water resistance.

The tissues are stored in layers in a rectangular parallelepiped box. The top of the box has an opening through which the tissues are successively pulled out for use. When one tissue is pulled out of the opening, the next tissue protrudes from the opening. In this way, the tissues are picked up one by one from the box. When the remaining tissues in the box become little, the tissues do not protrude from the opening one after another. Namely, some tissues are left on the bottom of the box and hardly picked up.

Some boxes for storing tissues has a perforated bottom that may be cut along perforations and inwardly raised when the remaining tissues become little, to entirely push up the remaining tissues. This may help the remaining tissues successively protrude from the box but not sufficient to surely protrude them until the last one. In addition, this technique is not so helpful to protrude the remaining tissues one by one, so that one may grab the remainder to cause a waste of tissues.

SUMMARY OF THE INVENTION

To solve these problems, an object of the invention is to provide a mechanism for automatically pushing up all tissues stored in a box. The mechanism is disposed inside the box, to surely and smoothly protrude the tissues one by one until the last one is picked up, thereby preventing a waste of tissues.

To accomplish the object, this invention provides a mechanism 10 for automatically pushing up tissues 14, including a box 12 for storing the tissues 14 in layers, a opening 16 formed on an upper wall B of the box 12, for picking up the tissues 14, and a pusher 20 disposed under the tissues 14, for pushing the tissues up.

The pusher 20 comprises a flat base 22 made of a relatively hard thin board for placing the tissues 14 thereon, a main leg 24 having one end fixed to the base 22 so that the main leg 24 may be freely folded relative to the base 22, and a subleg 26 being fixedly connected or engaged with the main leg 24, and for supporting the above-described base 22 in an approximately horizontal state by cooperating with the main leg 24. The main leg 24 and subleg 26 may have a force member 28 for always pushing the base 29 up.

The main leg 24 and subleg 26 may be connected with each other in an X shape to form an intersection 36. In this case, ends of the main leg 24 and subleg 26 are movable around the intersection 36. The force member 28 may be a rubber member 44 attached to lower ends of the main leg 24 and subleg 26.

Also, in the vicinity of the above-described main leg 24 or subleg 26, may be provided an initial uprise assisting member 54 for assisting the initial uprise of these main leg 24 and subleg 26.

Also, in the vicinity of the above-described main leg 24 and subleg 26 may be provided an uprise stop means 45 for restricting the position where the height of the legs becomes highest by the up and down movement of these main leg 24 and subleg 26.

Also, in the above-described uprise stop means 45, the initial uprise assisting member 54 may be provided.

Also, together with that the above-described main leg 24 is fixed on the lower surface of the base 22 in such a manner as its one end is free to be bent, the upper end of the subleg 26 is set on the lower surface of the above-described base 22 to be free to displace, and in the push up device 20, an inclination stop means 56 for preventing that the subleg 26 to become separated from subleg 26 and incline the base 22 to one direction may be provided.

The main leg 24 and subleg 26 may be disposed substantially in parallel with each other. In this case, a lower end of the main leg 24 is fixed to an upper surface of the subleg 26 so that the main leg 24 may be freely folded relative to the subleg 26. The force member 28 may be a rubber member 44 having one end fitted to one of the base 22 and main leg 24, and the other end to the subleg 26, to always raise the main leg 24.

The main leg 24 and subleg 26 may be disposed substantially in parallel with each other, and a folding axis 48 is formed at a substantial center of the main leg 24. The main leg 24 can be folded around the folding axis 48 in a longitudinal direction of the base 22. One end of the force member 28 is attached to the folding axis 48 and the other end thereof to the base 22 or the subleg 26, to move the base 22 away from the subleg 26. According to the invention, the pusher is disposed under the tissues in the box, and the elastic force of the force member always upwardly pushes the layered tissues from the bottom.

Accordingly, the mechanism of the invention helps the tissues to be surely and smoothly picked up one by one until the last one is picked up, thereby preventing a waste of tissues.

EXPLANATION OF EMBODIMENTS

In the following, preferred embodiments of the invention will be explained with reference to the drawings.

FIGS. 1 through 7 show a mechanism for automatically pushing up tissues according to the first embodiment of the invention.

Figure 1:
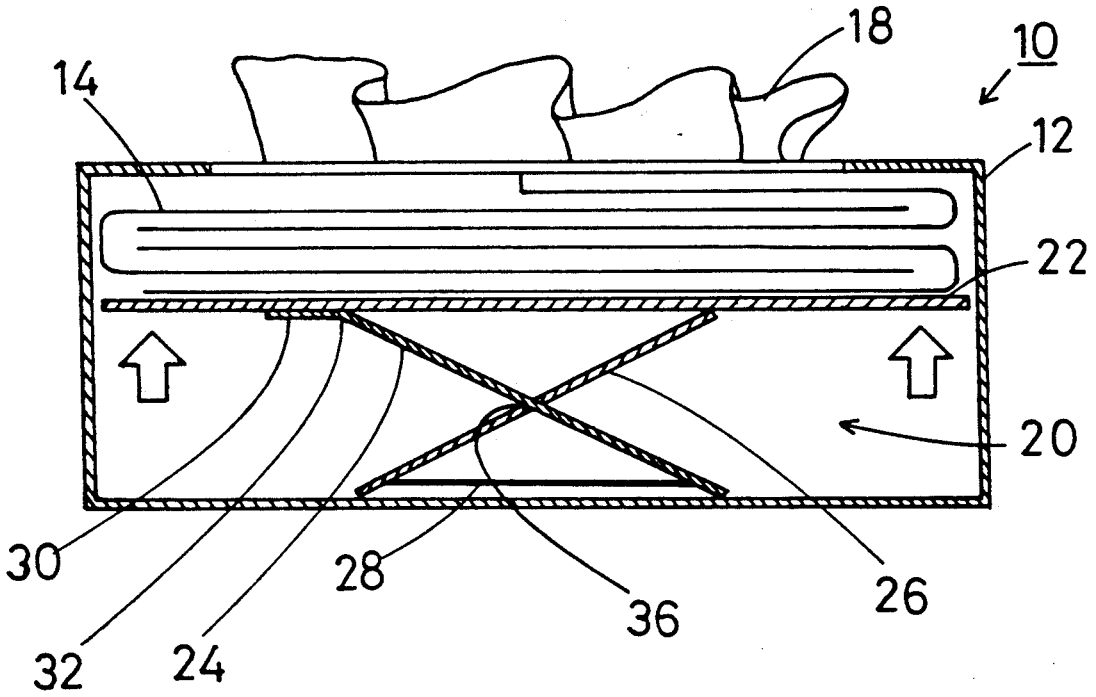
FIG. 1 is a vertical section schematically explaining a mechanism for automatically pushing up tissues according to a first embodiment of the invention.

FIG. 1 is a vertical section schematically showing the mechanism 10 for automatically pushing up tissues. The mechanism 10 comprises a rectangular parallelepiped box 12 (FIG. 7) made of relatively hard cardboard having a thickness of about 1 mm. The box 12 has side walls A, a top wall B, and a bottom wall C. Tissues 14 are stored in layers in the box.

The top wall B of the box 12 has an opening 16 extending along the length of the box 12. The tissues 14 are picked up one by one through the opening 16.

Figure 5:
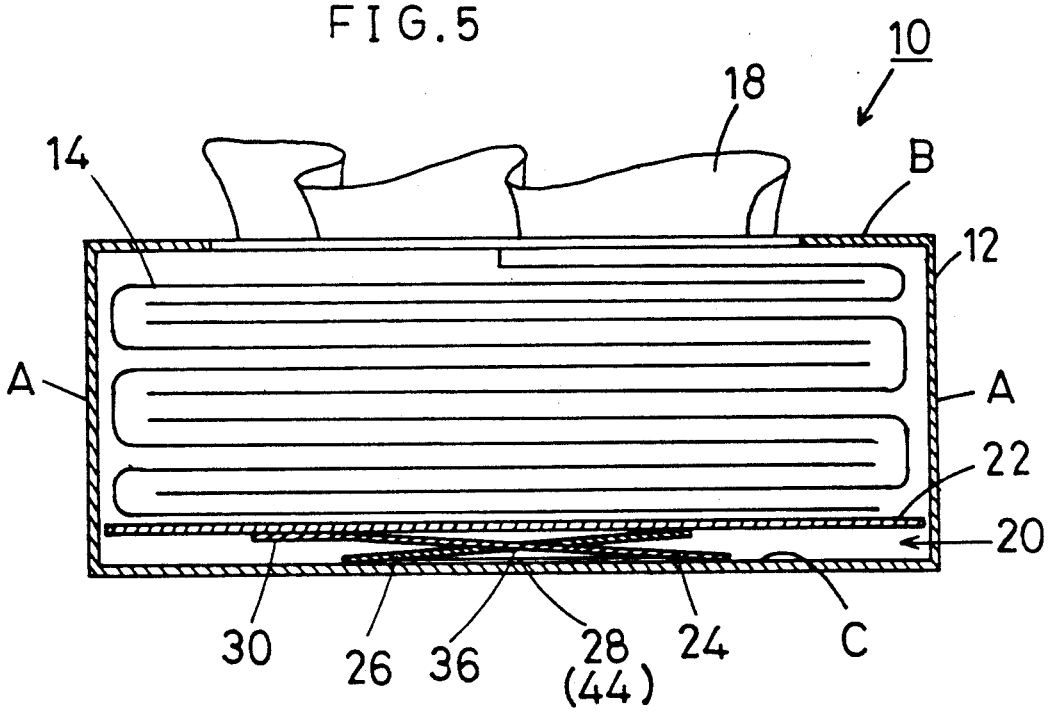
FIG. 5 is a vertical section schematically explaining the mechanism for automatically pushing up tissues fully filled in a box.

The tissues 14 are folded and alternatively nested in the box 12 so that, when one tissue is picked up, an upper end 18 of the next tissue may protrude from the opening 16 as shown in FIGS. 1 and 5. Namely, the tissues 14 may be successively picked up by the protruding ends.

This invention is characterized by a pusher 20. The pusher 20 is disposed under the lowest one of the tissues 14 in the box, to upwardly push all of the tissues 14 from the bottom as explained later.

Figure 2:
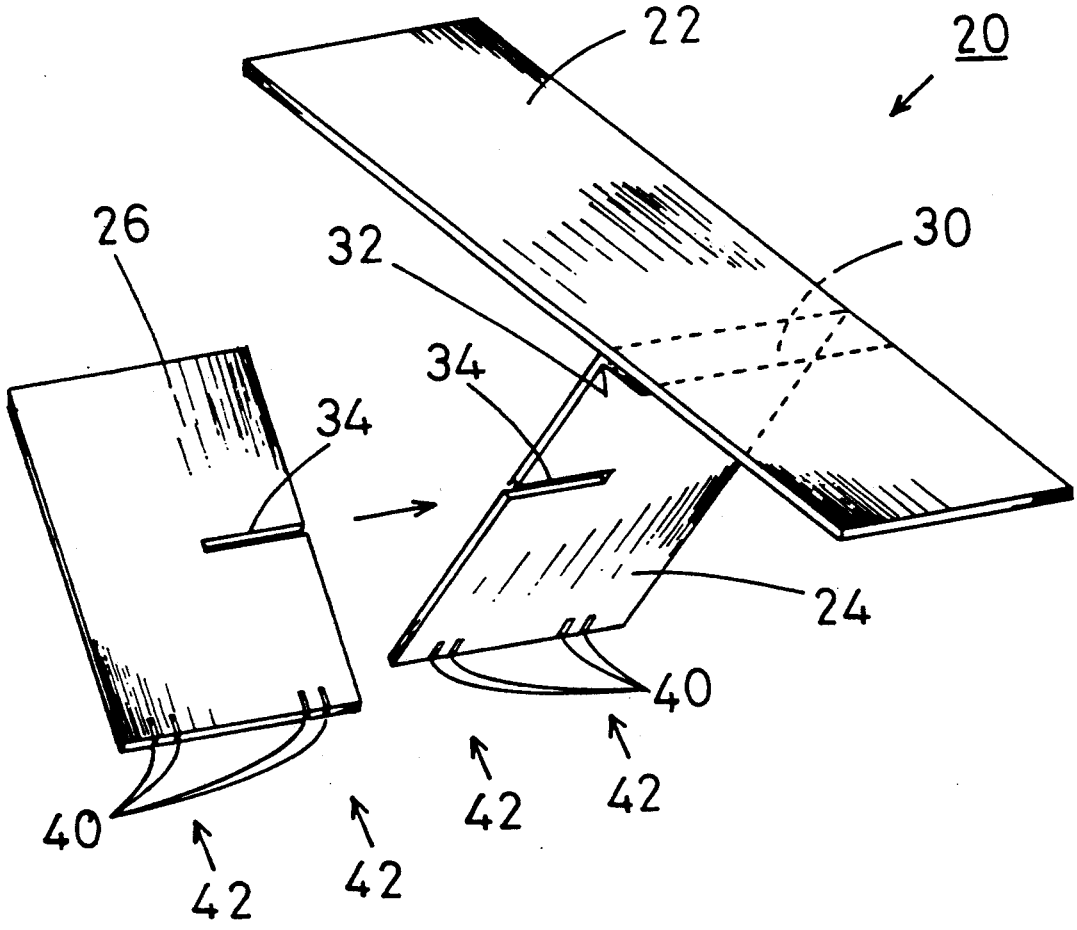
FIG. 2 is an exploded perspective view showing a pusher according to the first embodiment.
Figure 3:
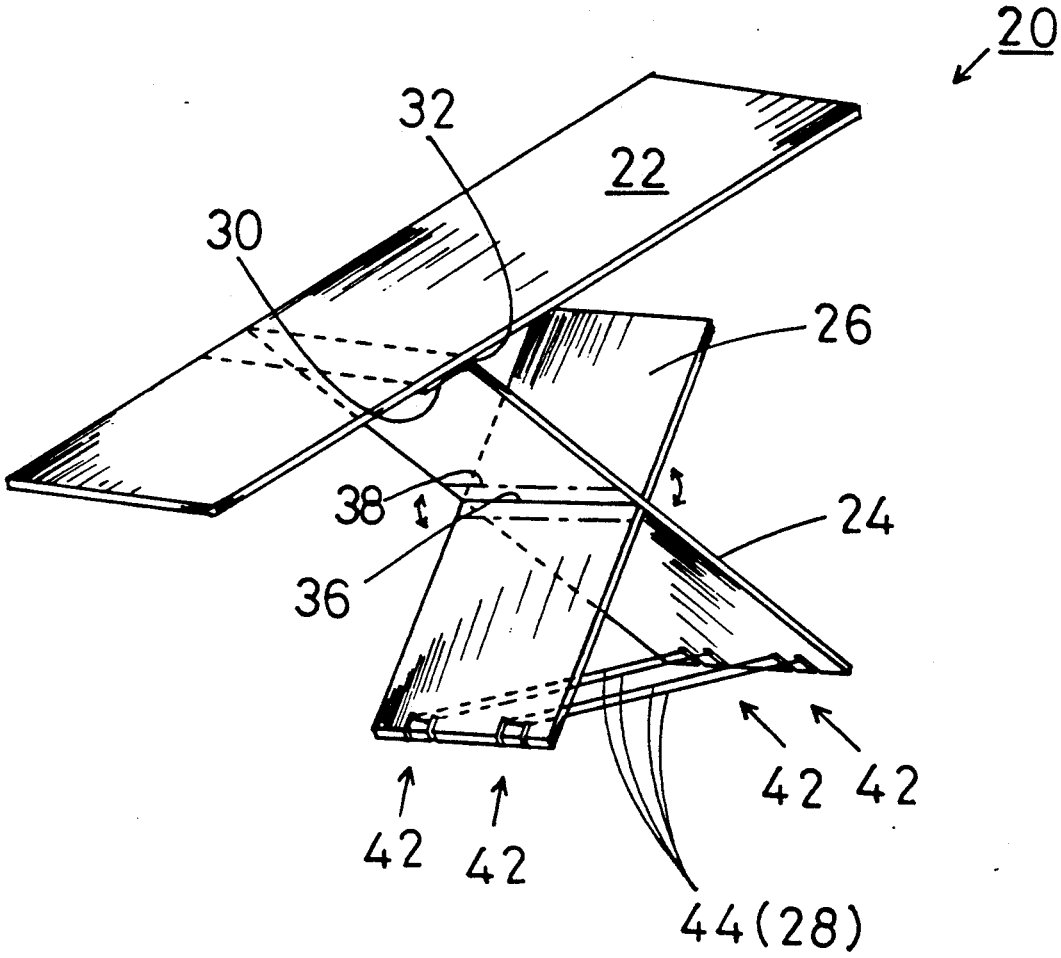
FIG. 3 is a perspective view showing an assembled state of the pusher.

In FIGS. 2 and 3, the pusher 20 of this embodiment is made of, similar to the box 12, relatively hard cardboard having a thickness of about 1 mm. Instead of the cardboard, any material such as plastics and light metal suitable for a tissue box may be employed for the pusher 20. The pusher 20 is disposed under the tissues in the box 12. The pusher 20 usually comprises a flat rectangular base 22 on which the tissues are placed in layers, a rectangular flat main leg 24 fit to a lower side of the base 22, a similarly flat rectangular sublet 26 for supporting the base 22 in approximately horizontal state by cooperating with this main leg 24, and a force member 28 stretched across the main leg 24 and the subleg 26, or between the base 22 and the legs 24 and 26.

The main leg 24 has a rectangular bent end 30 defined by a bend 32. With this bend 32, the bent end 30 is freely folded. The bent end 30 of the main leg 24 is fixed to the lower face of the base 22. A cut 34 of proper depth is formed substantially at the center of the main leg 24 in parallel with the bend 32.

The subleg 26 has the same shape as the main leg 24 minus the bent end 30. A cut 34 of proper length is formed substantially at the center of the subleg 26 at a position corresponding to the cut 34 of the main leg 24.

As shown in FIGS. 2 and 3, the main leg 24 and subleg 26 are engaged with each other through the cuts 34. This engagement forms an X-shaped intersection 36. To keep the engaged state of the legs 24 and 26, an adhesive tape 38 is attached along the intersection 36. With this arrangement, the legs 24 and 26 move like a proportional compass around the intersection 36 formed by the cuts 34, to thereby move ends of the legs 24 and 26 up and down.

Figure 4:
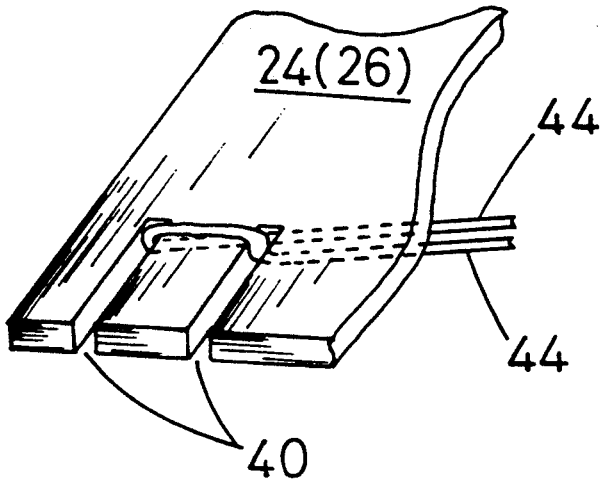
FIG. 4 is a perspective view showing a fitted state of a main leg (a subleg) and a force member.

As shown in FIG. 4, a lower end of each of the legs 24 and 26 has two pairs of parallel short cuts 40 to form stoppers 42. A rubber member 44 such as a rubber band serving as the force member 28 is fit into the opposing cuts 40 of the legs 24 and 26, to resiliently pull the lower ends of the legs 24 and 26 toward each other. As a result, the base 22 is always pushed up. In this way, the pusher 20 as a whole operates like a pantograph around the intersection 36 of the cuts 34.

In FIG. 3, the subleg 26 may have a bent end 30 that is fixed to the lower face of the base 22.

Figure 11:
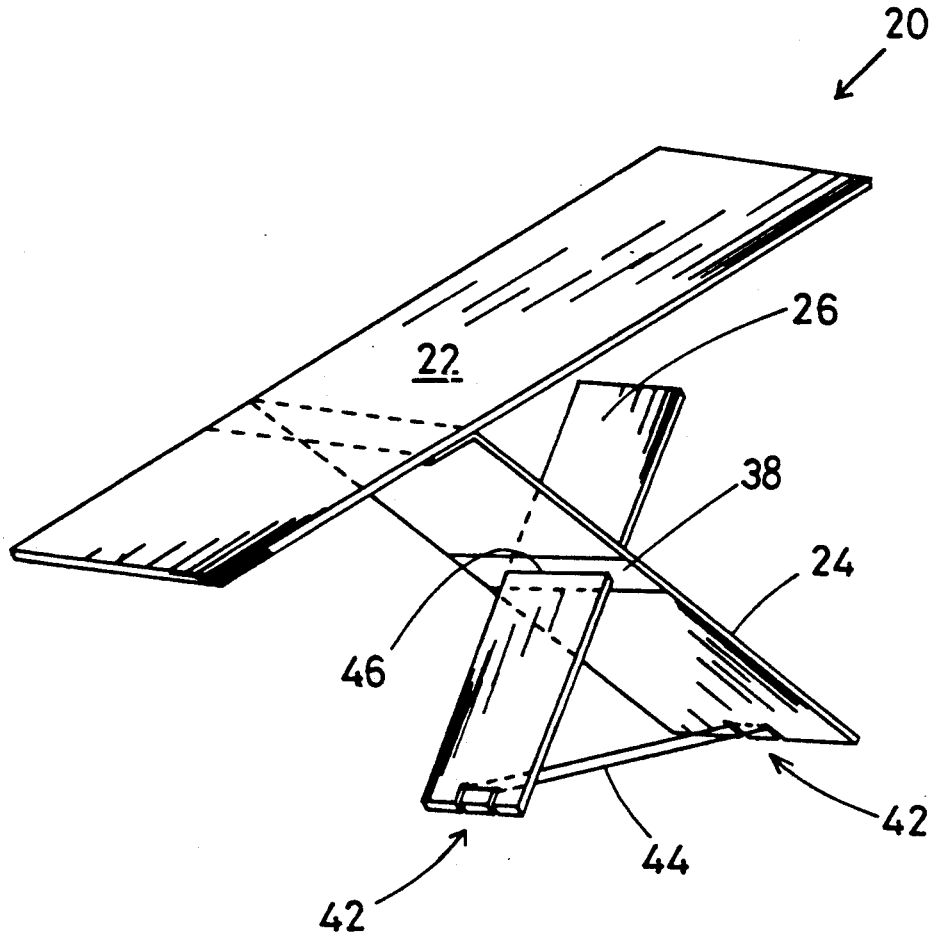
FIGS. 11, 12(*a*), and 12(*b*) are outline perspective diagrams showing another state of the X-shaped combination of the main leg and subleg.

FIG. 11 shows a narrow subleg 26 and a main leg 24 having an insertion groove 46 formed laterally at the center thereof. The subleg 26 is inserted into the groove 46 to form an X shape. A adhesive tape is applied to an intersection of the X.

Figure 12A:
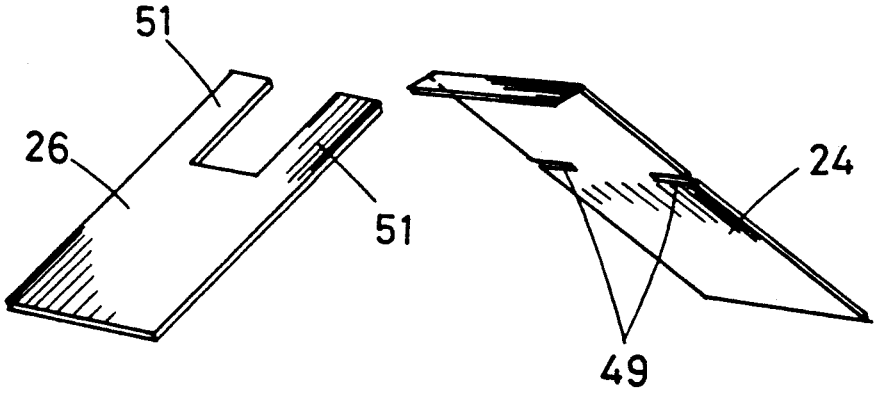
Figure 12B:
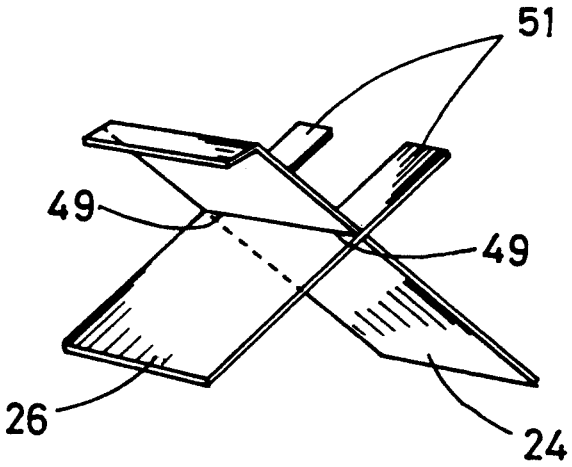

Or, as shown in FIGS. 12(*a*) and (*b*), slit grooves 49 are drilled at the upper sides of the main leg 26, and in such a manner as to form an insertion plate 51 of the width capable to be inserted to these slit groove 49, the upper part center of this subleg 26 is cut off, and the main leg and subleg may be formed by assembling them in an X shape.

For the sake of easy under-standing of the figures, the thickness of the base 22, main leg 24, subleg 26, etc., of the pusher 20 are depicted unnaturally thick compared with the dimensions of the box 12. In practice, the length, width, and height of the box 12 are usually $11.5 \times 24.8 \times 8.3$ (cm), and the box 12 is filled with the tissues 14 to forcibly push down the pusher 20, which is therefore folded into a flat shape as shown in FIG. 5. Since the pusher 20 is made of paper, it is very light, and since it is folded flat, it secures a sufficient space for storing the tissues 14 in the box 12.

Figure 6:
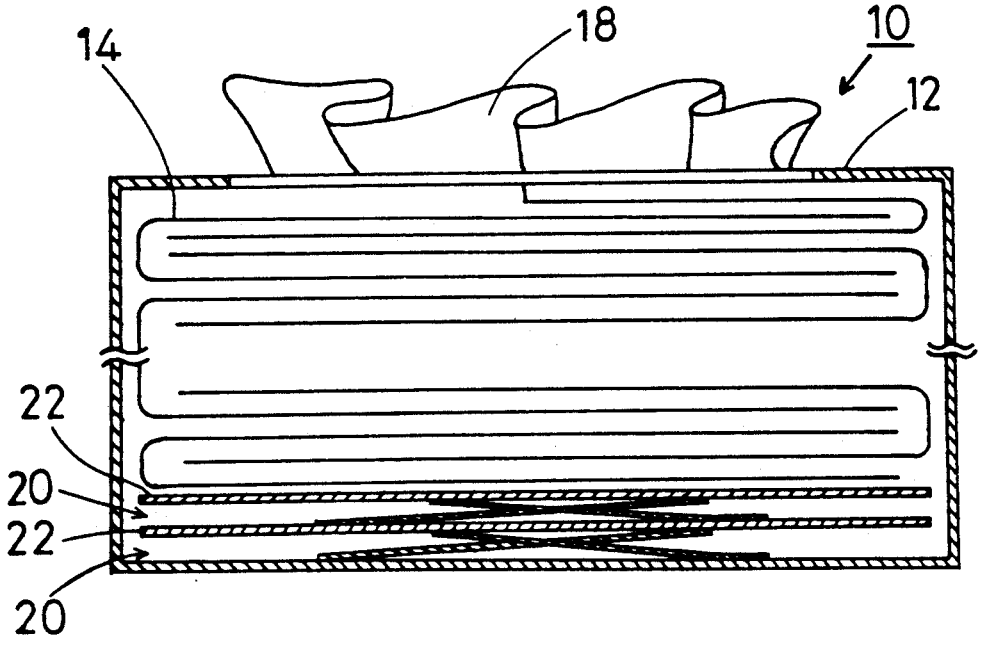
FIG. 6 is a partly omitted vertical section schematically explaining a mechanism having two stages of pushers for automatically pushing up tissues according to the invention.
Figure 7:
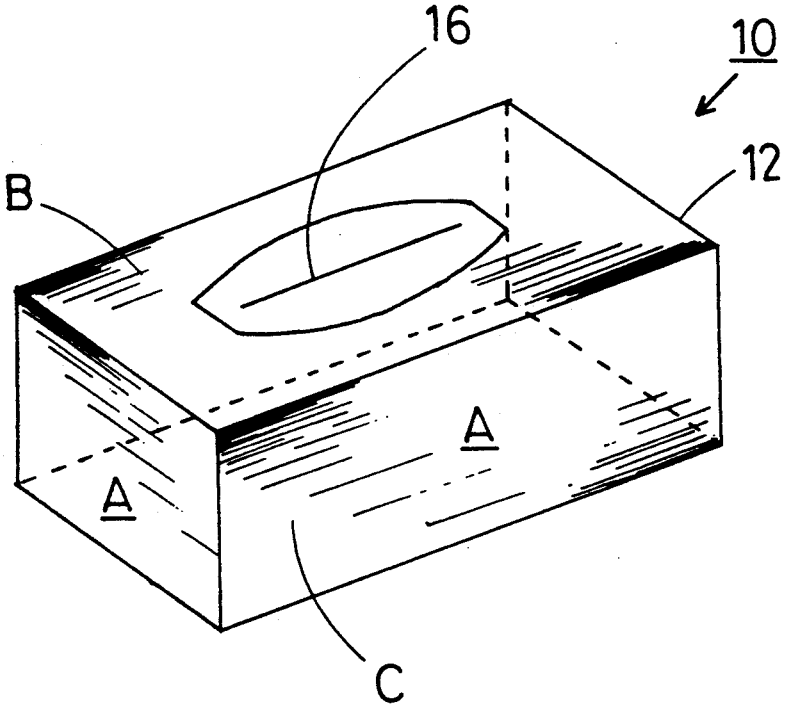
FIG. 7 is a general perspective view showing the tissue containing box.

FIG. 6 shows an example having two stages of pushers 20. If the rubber member 44 of each pusher 20 has an elastic force of pushing up one box of tissues, this example is capable of pushing up two boxes of tissues to smoothly protrude the tissues one after another. This example thus realizes a box whose tissue storing capacity is double that of the conventional box.

To fabricate and use the mechanism 10 of the invention, the pusher 20 with the base 22 at the top thereof is disposed inside the box 12 as shown in FIG. 5. The base 22 is pushed down against the elastic contraction force, i.e., lifting force of the force member 28, to thereby form a tissue storage space, which is fully filled with tissues. The base 22 is pushed to the bottom to completely flatten the pusher 20 as shown in FIG. 5.

From this state, the tissues 14 are picked up one by one through the opening 16 and used. Since the tissues are nested in a known way, the upper part 18 of each tissue protrudes from the opening 16 one after another.

The elastic contraction force of the rubber member 44 of the pusher 20 is so set that the base 22 is raised to a height of about 80% to 90% of the full height of the box 12 when the remnants of the tissues become about one third or one fourth of the full amount in the box 12. At this height, the rubber member 44 provides no more contraction force. When the base 22 is pushed below that height, the legs 24 and 26 are folded around the intersection 36, and the rubber member 44 starts to provide the elastic contraction force.

This arrangement produces a proper upward pushing force as the tissues are successively picked up from the fully filled state and continuously protrudes the edge of each tissue until the last one is picked up, so that one can smoothly pick up the tissues to the last one.

The pusher according to the embodiment is made of relatively hard paper and has a simple structure, so that it can be formed at a very low cost. Accordingly, the pusher of the invention is proper for adding a value to a tissue box which itself is a low-cost product.

If the remaining tissues become little and if the force member 28 hardly pulls the legs 24 and 26, the box 12 may be simply turned upside down to activate the contraction force of the force member 28 and push up the base 22 and tissues 14.

To indicate the timing of turning the box 12 upside down, a colored tissue may be inserted at a proper height position in the stacked tissues 14. When the colored tissue appears after consecutive use of the tissues 14, the box may be turned upside down.

Next, explanation will be given on another embodiment of the automatic tissue paper pushing up mechanism according to the invention, and as to the same member as that in the first embodiment, the same symbol is attached and the explanation thereof is omitted.

Figure 8:
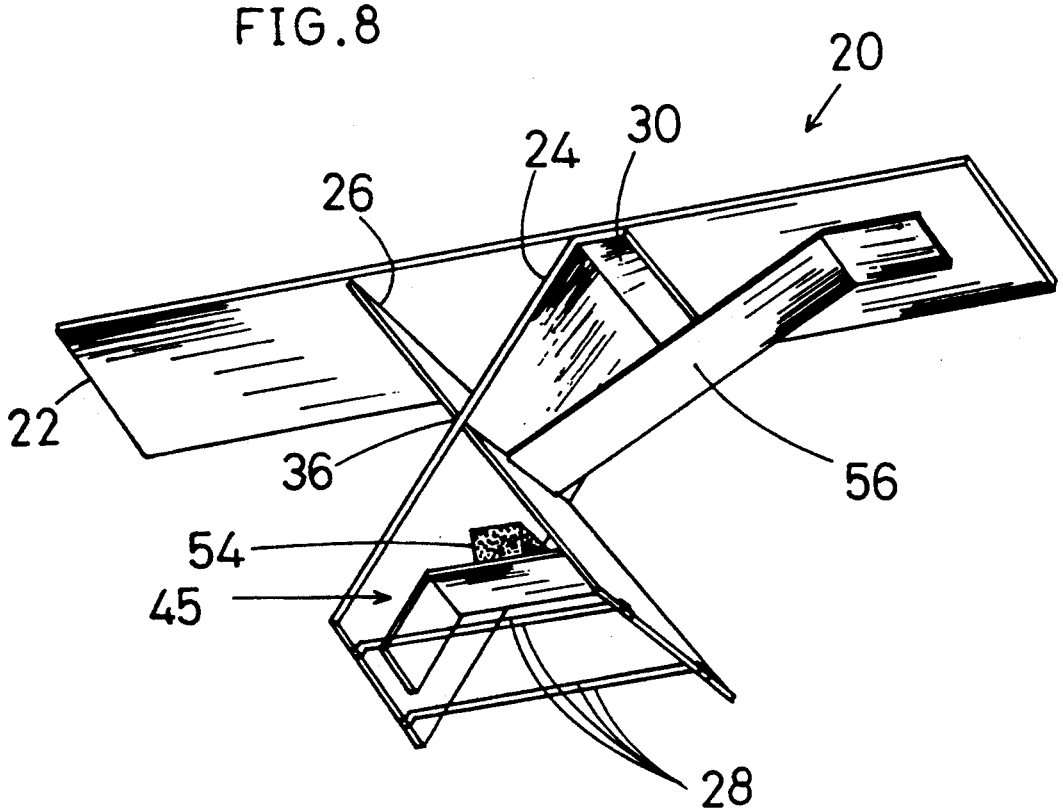
FIG. 8 is a perspective explaining diagram of the push up device of the automatic tissue paper pushing up mechanism according to the second embodiment of the invention.
Figure 9:
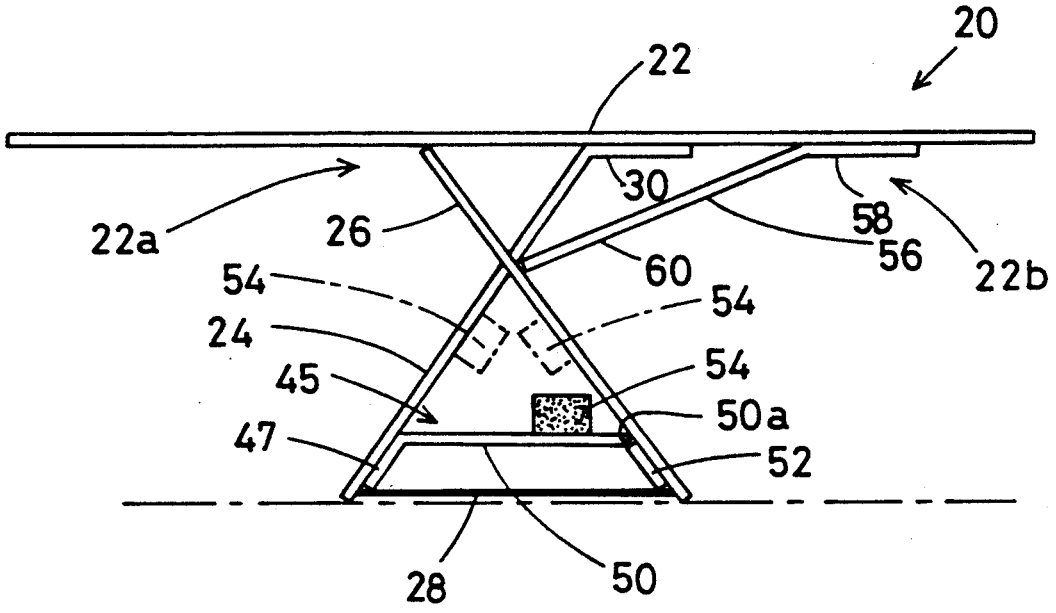
FIG. 9 is a plan diagram thereof.
Figure 10:
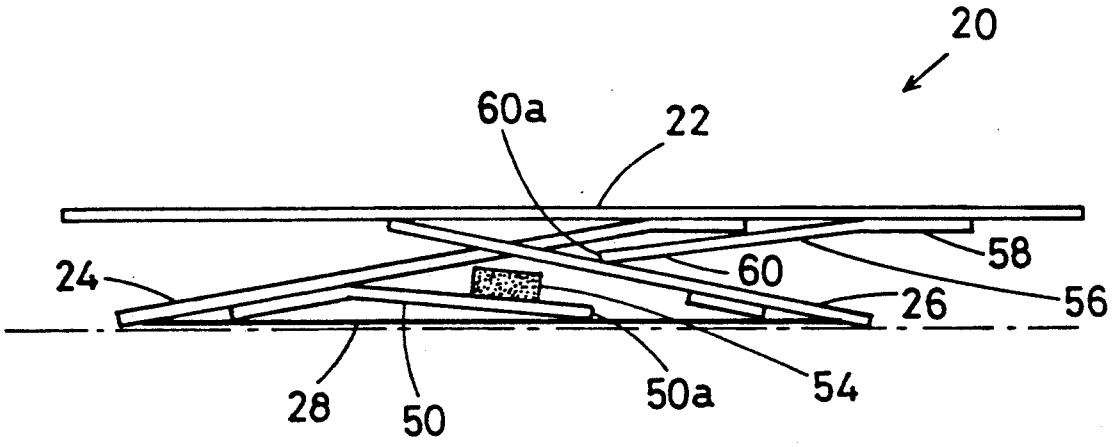
FIG. 10 is an explanatory diagram of the state where this pushing up device has been shrinked.

FIGS. 8 through 10 show the second embodiment.

In this embodiment, the main leg and subleg are constructed in X form, and between the intersection part thereof 36 and the force member 28 provided at the lower end parts of respective legs 24 and 26 is provided an uprise stop device 45 for restricting the position where the height of the legs become highest by the up and down movement of these main leg and subleg. That is, in the inside of the main leg 24, a break end 47 is fixed, and to this break end 47, a horizontal plate 50 is connected free to broken. Also, at the inside position of the subleg 26 corresponding to almost the attached position of this break end 47, a stopper member 52 is fixed, and thereby the end part **50*a* of the horizontal plate 50 becomes in a free state in such a manner that the whole push up device are made shrinked by applying load from above as shown in FIG. 10, but in such a state as shown in FIG. 9 where respective legs 24 and 26 has pushed up the base 22 by canceling the load from upside, the same horizontal plate end part 50*a* is restricted by the stopper member 52 to move along the inside of the subleg 26**, and is stopped and preserved almost in a horizontal state.

Here, in the pantograph like up and down movement of the main leg 24 and subleg 26 by making the intersection part 36 as a pivot axis, the position where the height of legs become highest is restricted, and thereby, the remaining tissue paper 14 mounted on the base 22 becomes fewer, and is strongly pushed to the ceiling part of the inside of the same box 12 to become difficult to be taken out, and such defect that the tissue paper becomes torn when taken out, is to be removed.

Further, in this embodiment, an initial uprise assisting member 54 is provided on the upper face of the horizontal plate 50 of the uprise stop device 45.

This initial uprise assisting member 54 is formed, for example, in an interior box form consisting of an elastic body having high expansion and shrinkage properties such as a sponge. This initial uprise assisting member 54 is placed at a position where the support point as the pivot axis of the intersection part 36 overlaps to the linear part formed by the rubber member 44 as the force member in the state that the pusher 20 has been shrinked in such a manner as shown in FIG. 5 in the first embodiment, and therefore, in the case when the tissue paper in the box 12 becomes gradually used and the load is gradually reduced, there was such a case that the uprise performance of both legs by the force member 28 is not carried out. In order to prevent such a fact, that position of the intersection part 36 is made elastically uprisen accompanying the gradual reduction of the load by compressing the pusher, and by attaching the initial stage uprise assisting member 54 on the upper face of the horizontal plate 50, this can be attained. That is, this initial stage uprise assisting member 54 is provided to assist the uprise performance of the main leg 24 and subleg 26.

Accordingly, it will do that the intersection part 36 is made lifted up a little, and the attaching position of this initial stage uprise assisting member 54 is not limited to the upper face of the horizontal plate 50, but may be attached to the inside surface of the underside of the intersection part 36 of the main leg 24 as shown by the dotted line of FIG. 9, the inside surface of the subleg corresponding thereto, the outside thereof, in and outside of the upper side of the intersection part, or the lower surface of the base 22. In addition thereto, in this embodiment, an inclination stop means 56 is provided in this pusher 20.

In FIG. 8, 9, and 10, the main leg 24 is fixed at the lower surface of the base 22 such as one end thereof is free to be bent and at the same time, the upper end of the subleg 26 is slidably engaged at contact port **22*a* with the lower surface of the above-described base 22. Then, on the pusher 20, the inclination stop means 56 for preventing the inclination of the base 22 by being separated from the subleg 26 is provided. This inclination stop means 56 has the bent end 58 adhered and fixed to the base lower surface at another end side 22*b*. The adhering part to the base 22 of the bent end 30 of the main leg 24 is in the center, and the protruding plate 60 connected to bent end 58 is free to bend. This protruding plate 60 has a required length, and in the shrinked state of the pusher 20 as shown in FIG. 10, the tip thereof is in a free state, but as the height of the main leg and the subleg constructed in X form becomes higher, and the intersection part 36 thereof also becomes higher, the tip part 60*a* approaches this intersection part 36, and further, when this intersection part 36 and the tip part 60*a* of the protruding plate 60 are butted against each other, since the bent end 58 and the base 22 are fixed free to bend, the base of the contact part 22*a* in the side of the subleg 26 is prevented from the inclination movement (float up and incline) to supper side. Thereby, in the embodiment shown in FIG. 6, in the case when a box of deep depth is formed, and the pushers 20 were used by overlapping in two stages, any of the bases of the pusher positioned in the lower stage can be prevented from becoming floated up and inclined by falling down and become unable to function in the box, and thereby, since the base 22** does not incline and becomes stabilized, even when the pushing mechanism is used in the case by overlapping them more than two, the pusher becomes stably working.

Next, explanation will be given on another embodiment of a mechanism for automatically pushing up tissues according to the invention, and for the same member as that in the first embodiment, the same symbol is attached and the explanation thereof will be omitted.

Figure 13:
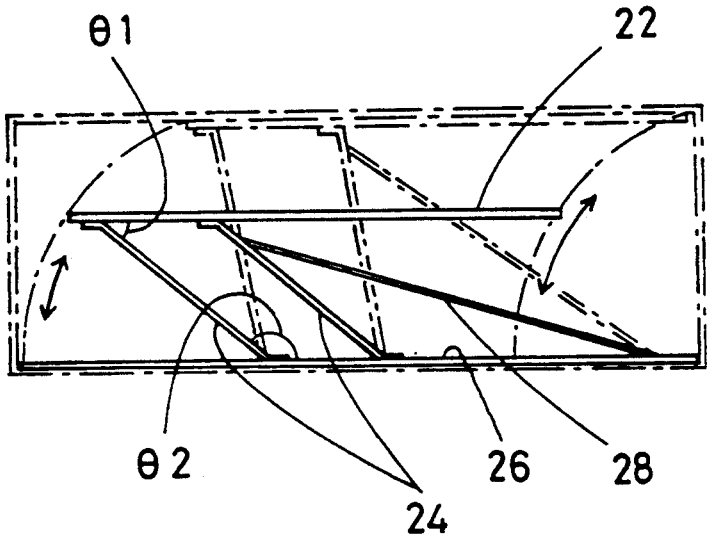
FIG. 13 is an outline side surface diagram of the push up device according to the third embodiment of the invention.
Figure 14:
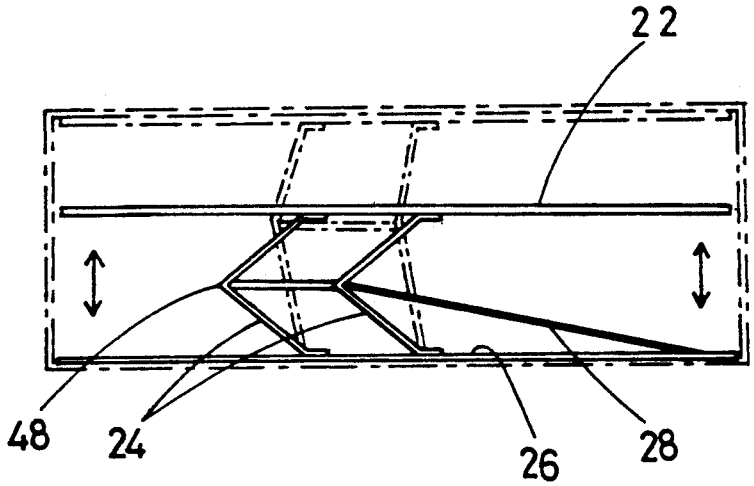
FIG. 14 is a side surface outline diagram of the push up device according to the fourth embodiment of the invention.

FIG. 13 shows the third embodiment.

A subleg 28 of this embodiment is arranged substantially in parallel with the base 22. The main leg 24 has upper and lower bent ends that are fixed to a base 22 and the subleg 20, respectively. The main leg 24 is freely folded relative to the base 22 and subleg 26 through bends 32. A folding axis 48 is formed substantially at the center of the main leg 24 so that the main leg 24 may be folded at the center in a longitudinal direction of the base 22.

A force member 28 has one end attached to the folding axis 48 and the other end to the base 22 or the subleg 26, to elastically separate the base 22 away from the subleg 26, thereby upwardly pushing the base 22. A force exerted by the force member 28 is so set to fold the main leg 24 around the folding axis 48 at an angle smaller than 180 degrees. This embodiment also realizes a simple structure at a low cost.

Other than these embodiments, the pusher may be realized by simply arranging spring members under tissues at four corners in a box, or by other structures. The arrangements of the embodiments, however, are most preferable.

As explained above, this invention provides a mechanism for automatically pushing up tissues. The mechanism employes a pusher disposed in a box for storing the tissues, to push up the tissues from below. The mechanism protrudes the tissues one after another until the last one is used, so that one may smoothly pick up the tissues one by one without wasting the tissues.

What is claimed is:

1. A mechanism for automatically pushing up tissues, comprising:
- a box for storing the tissues in layers, said box having a top wall with an opening formed therein for picking up tissues therethrough;
- a pusher disposed under the tissue in said box for pushing up the tissues, said pusher including,
  - a flat base having a lower face and an upper face on which the tissues are placed in layers,
  - a main leg having a lower end and an upper end, the upper end fixed to the lower face of the base so that the main leg may be freely folded relative to the base,
  - a subleg connected to the main leg and having a lower end and an upper end, the upper end of the subleg contacting the lower face of the base, the upper end of the subleg displaced from the upper end of the main leg for supporting the base in a substantially horizontal state, and
  - a force member attached to the main leg and subleg for forcing the main leg and subleg to push up the base.

2. The mechanism according to claim 1, wherein the main leg and subleg are connected to each other in an X shape so that the upper end of the main leg and the upper end of the subleg move up and down around an intersection of the X shape, and the force member is a rubber member engaging the lower ends of the main leg and subleg.

3. The mechanism according to claim 2, further comprising an initial stage uprise assisting member for assisting an initial stage uprise of the main leg and the subleg, the initial stage uprise assisting member being provided on one of the main leg and the subleg.

4. The mechanism according to claim 3, further comprising an uprise stop means for restricting movement of the main leg and subleg when the base reaches a predetermined height.

5. The mechanism according to claim 2, further comprising an uprise stop means for restricting movement of the main leg and the subleg when the base reaches a predetermined height.

6. The mechanism according to claim 5, wherein an initial stage uprise assisting member for assisting an initial stage uprise of the main leg and the subleg is provided on the uprise stop means.

7. The mechanism according to claim 2, further comprising inclination stop means for preventing the base from inclining in a given direction, and wherein the upper end of the subleg is displaceable along the lower face of the base.

8. A mechanism for automatically pushing up tissue, comprising:
- a box for storing the tissues in layers, said box having a top wall with an opening formed therein for picking up tissues therethrough;
- a pusher disposed under the tissues in said box for pushing up the tissues, said pusher including,
  - a flat base having a lower face and an upper face on which the tissues are placed in layers,
  - a main leg having a first end and a second end, the first end of the main leg fixed to the lower face of the base so that the main leg may be freely folded relative to the base,
  - a subleg having a lower face and an upper face, the subleg being arranged substantially parallel with the base, the second end of the main leg being fixed to the upper face of the subleg, and
  - a force member having a first and second end, the first end of the force member attached to one of the base and the main leg and the second end of the force member attached to the subleg at a position to produce a force that acts to raise the main leg.

9. A mechanism for automatically pushing up tissues, comprising:
- a box for storing the tissues in layers, said box having a top wall with an opening formed therein for picking up tissues therethrough;
- a pusher disposed under the tissues in said box for pushing up the tissues, said pusher including,
  - a flat base having a lower face and an upper face on which the tissues are placed in layers,
  - a subleg arranged substantially parallel with the base, and
  - a main leg having a first end, a second end and a center, the first end of the main leg fixed to the lower face of the base so that the main leg may be freely folded relative to the base, and the main leg having a folding axis formed substantially at the center of the main leg so that the main leg is freely folded in a longitudinal direction of the base, and
- a force member for forcing the main leg to push up the base, the force member having a first and second end, the first end of the force member being attached to the folding axis and the second end of the force member being attached to one of the base and the subleg.

* * * * *